US006998826B2

(12) United States Patent
Fukui

(10) Patent No.: US 6,998,826 B2
(45) Date of Patent: Feb. 14, 2006

(54) VOLTAGE REGULATOR

(75) Inventor: Atsuo Fukui, Chiba (JP)

(73) Assignee: Seiko Instruments Inc., Chiba (JP)

( * ) Notice: Subject to any disclaimer, the term of this patent is extended or adjusted under 35 U.S.C. 154(b) by 89 days.

(21) Appl. No.: 10/659,505

(22) Filed: Sep. 10, 2003

(65) Prior Publication Data

US 2005/0029999 A1 Feb. 10, 2005

(30) Foreign Application Priority Data

Sep. 25, 2002 (JP) ..... 2002-279014

(51) Int. Cl.
*G05F 1/40* (2006.01)

(52) U.S. Cl. ..... 323/282

(58) Field of Classification Search ..... 323/268, 323/271, 280, 281, 282, 284, 289
See application file for complete search history.

(56) References Cited

U.S. PATENT DOCUMENTS 4,841,219 A * 6/1989 Lonergan ..... 323/274
6,509,723 B1 * 1/2003 Matsushita ..... 323/281
6,559,626 B1 * 5/2003 Horie ..... 323/282
6,608,520 B1 * 8/2003 Miyazaki ..... 327/540

* cited by examiner

*Primary Examiner*—Matthew V. Nguyen
(74) *Attorney, Agent, or Firm*—Adams & Wilks

(57) ABSTRACT

To provide a voltage regulator that operates even when an input power source voltage and an output voltage are small, that is, even when the difference between input and output voltages is small. The voltage regulator includes: a reference voltage source for outputting a reference voltage; a voltage dividing circuit for dividing an output voltage; a feedback voltage terminal to which a voltage obtained by dividing the output voltage is outputted; an error amplifier to which the reference voltage and a voltage from the feedback voltage terminal are inputted; a first transistor of a first conductivity type, which is connected in series between the voltage dividing circuit and an input power source terminal; and an overcurrent limiting circuit for outputting a signal for controlling the first transistor in response to an output of the error amplifier, and in the voltage regulator, the overcurrent limiting circuit includes a differential pair for outputting the signal for controlling the first transistor in response to a signal inputted to the error amplifier.

2 Claims, 4 Drawing Sheets

VOLTAGE REGULATOR

BACKGROUND OF THE INVENTION

1. Field of the Invention

The present invention relates to a voltage regulator, more particularly to a fold-back type overcurrent limiting circuit thereof.

2. Description of the Related Art

A circuit as shown in FIG. 3 has been known as a conventional voltage regulator including a fold-back type overcurrent limiting circuit (for example, see JP 07-074976 B (FIG. 1)).

The voltage regulator section includes a reference voltage source 100, an error amplifier 101, a P-channel enhancement type MOS driver transistor 102, and a voltage dividing circuit composed of resistors 106 and 107. The error amplifier 101 compares a feedback voltage with a reference voltage and adjusts a gate voltage of the P-channel enhancement type MOS driver transistor 102 so that both voltages coincide with each other.

The fold-back type overcurrent limiting circuit is composed of the P-channel enhancement type MOS driver transistor 102, a P-channel enhancement type MOS sense transistor 103 in which the gate and the source thereof are common to the P-channel enhancement type MOS driver transistor 102, a resistor 108, an N-channel enhancement type MOS transistor 105, a resistor 109, and a P-channel enhancement type MOS transistor 104. One end of the resistor 108 is connected with the drain of the P-channel enhancement type MOS sense transistor 103 and the other end thereof is connected with an output voltage terminal 201. The gate of the N-channel enhancement type MOS transistor 105 is connected with the drain of the P-channel enhancement type MOS sense transistor 103, the source thereof is connected with the output voltage terminal 201, and the back gate thereof is grounded. One end of the resistor 109 is connected with the drain of the N-channel enhancement type MOS transistor 105 and the other end thereof is connected with a power source terminal. The gate of the P-channel enhancement type MOS transistor 104 is connected with the drain of the N-channel enhancement type MOS transistor 105, the source thereof is connected with the power source terminal, and the drain thereof is connected with the output voltage terminal of the error amplifier 101, the gate of the P-channel enhancement type MOS sense transistor 103, and the gate of the P-channel enhancement type MOS driver transistor 102.

When an input power source voltage and an output voltage are small in the conventional fold-back type overcurrent limiting circuit, that is, when a difference between input and output voltages is small, the fold-back type overcurrent limiting circuit does not operate. Accordingly, the output voltage does not lower to a level at which the supply of an output current from the P-channel enhancement type MOS driver transistor 102 becomes impossible, so that a relationship between the output voltage and the output current tend to become a relationship as shown in FIG. 4.

In order to make a change for the better regarding this point, a voltage regulator including a drooping type overcurrent limiting circuit in addition to the conventional fold-back type overcurrent limiting circuit has been devised. FIG. 5 shows a circuit example of the voltage regulator. In FIG. 5, the drooping type overcurrent limiting circuit is composed of the P-channel enhancement type MOS driver transistor 102, a P-channel enhancement type MOS sense transistor 110 in which the gate and the source thereof are common to the P-channel enhancement type MOS driver transistor 102, a resistor 111, an N-channel enhancement type MOS transistor 112, a resistor 113, and a P-channel enhancement type MOS transistor 114. One end of the resistor 111 is connected with the drain of the P-channel enhancement type MOS sense transistor 110 and the other end thereof is grounded. The gate of the N-channel enhancement type MOS transistor 112 is connected with the drain of the P-channel enhancement type MOS sense transistor 110, the source thereof is grounded. One end of the resistor 113 is connected with the drain of the N-channel enhancement type MOS transistor 112 and the other end thereof is connected with an input power source terminal. The gate of the P-channel enhancement type MOS transistor 114 is connected with the drain of the N-channel enhancement type MOS transistor 112, the source thereof is connected with the input power source terminal, and the drain thereof is connected with the output voltage terminal of the error amplifier 101, the gate of the P-channel enhancement type MOS sense transistor 110, and the gate of the P-channel enhancement type MOS driver transistor 102.

Even in the case where an input power source voltage and an output voltage are small in the circuit shown in FIG. 5, that is, even in the case where a difference between input and output voltages is small, when an output current becomes larger, first, the drooping type overcurrent limiting circuit operates to limit an overcurrent, thereby reducing the output voltage. Consequently, a difference between the input power source voltage and the output voltage becomes larger. Thus, the fold-back type overcurrent limiting circuit operates, with the result that a relationship between the output voltage and the output current becomes a relationship as shown in FIG. 6.

As described above, according to the conventional voltage regulator including the fold-back type overcurrent limiting circuit as shown in FIG. 3, when the input power source voltage and the output voltage are small, that is, when the difference between the input and output voltages is small, the fold-back type overcurrent limiting circuit does not operate. Accordingly, the output voltage does not lower to a level at which the supply of the output current from the P-channel enhancement type MOS driver transistor 102 becomes impossible, so that the relationship between the output voltage and the output current tend to become the relationship as shown in FIG. 4.

On the other hand, as a circuit for solving such problem, the voltage regulator including both the fold-back type overcurrent limiting circuit and the drooping type overcurrent limiting circuit as shown in FIG. 5 is given. However, because the voltage regulator includes both the fold-back type overcurrent limiting circuit and the drooping type overcurrent limiting circuit, there is a drawback that a circuit scale is increased.

SUMMARY OF THE INVENTION

In order to solve the above-mentioned problems, according to the present invention, there is realized with a simple circuit a fold-back type overcurrent limiting circuit which operates even when the difference between input and output voltages is small.

According to the present invention, there is provided a voltage regulator, including:

a reference voltage source for outputting a reference voltage;

a voltage dividing circuit for dividing an output voltage;

a feedback voltage terminal to which a voltage obtained by dividing the output voltage is outputted;

an error amplifier to which the reference voltage and a voltage from the feedback voltage terminal are inputted;

a first transistor of a first conductivity type, which is connected in series between the voltage dividing circuit and an input power source terminal; and an overcurrent limiting circuit for outputting a signal for controlling the first transistor in response to an output of the error amplifier, in which the overcurrent limiting circuit includes:

a second transistor of the first conductivity type, which is connected between the input power source terminal and the error amplifier;

a first resistor connected between the input power source terminal and a terminal to which a signal for controlling the second transistor is inputted;

a third transistor of a second conductivity type, which is connected between the terminal to which the signal for controlling the second transistor is inputted and a ground potential terminal;

a second resistor connected between a terminal to which a signal for controlling the third transistor is inputted and the ground potential terminal;

a fourth transistor of the first conductivity type, which is connected between the input power source terminal and the second resistor, the output of the error amplifier being inputted to a control terminal of the fourth transistor; and a differential pair having a first input terminal and a second input terminal, which is connected between the fourth transistor and the second resistor, the first input terminal of the differential pair being connected with the feedback voltage terminal, and the second input terminal of the differential pair being connected with an output terminal of the reference voltage source.

Further, according to the voltage regulator of the present invention, the differential pair includes:

a fifth transistor of the first conductivity type, which has the first input terminal; and a sixth transistor of first conductivity type, which has the second input terminal, the fifth transistor being connected between the second resistor and the fourth transistor, and the sixth transistor being connected between the ground potential terminal and the fourth transistor.

Furthermore, according to the present invention, there is provided a voltage regulator, including:

a reference voltage source for outputting a reference voltage;

a voltage dividing circuit for dividing an output voltage;

a feedback voltage terminal to which a voltage obtained by dividing the output voltage is outputted;

an error amplifier to which the reference voltage and a voltage from the feedback voltage terminal are inputted;

a first transistor of a first conductivity type, which is connected in series between the voltage dividing circuit and an input power source terminal; and an overcurrent limiting circuit for outputting a signal for controlling the first transistor in response to an output of the error amplifier, in which the overcurrent limiting circuit includes a differential pair for outputting the signal for controlling the first transistor in response to a signal inputted to the error amplifier.

DETAILED DESCRIPTION OF THE PREFERRED EMBODIMENT

According to the present invention, a differential pair is added to a conventional drooping type overcurrent limiting circuit which operates even when an input power source voltage and an output voltage are small, that is, even when a difference between input and output voltages is small. In addition to this, a feedback voltage obtained by dividing the output voltage by resistors is applied to one of the differential pair. Thus, a fold-back type overcurrent limiting circuit which operates even when the input power source voltage and the output voltage are small, that is, even when the difference between the input and output voltages is small is constructed.

Hereinafter, an embodiment of the present invention will be described with reference to the drawings.

Figure 1:
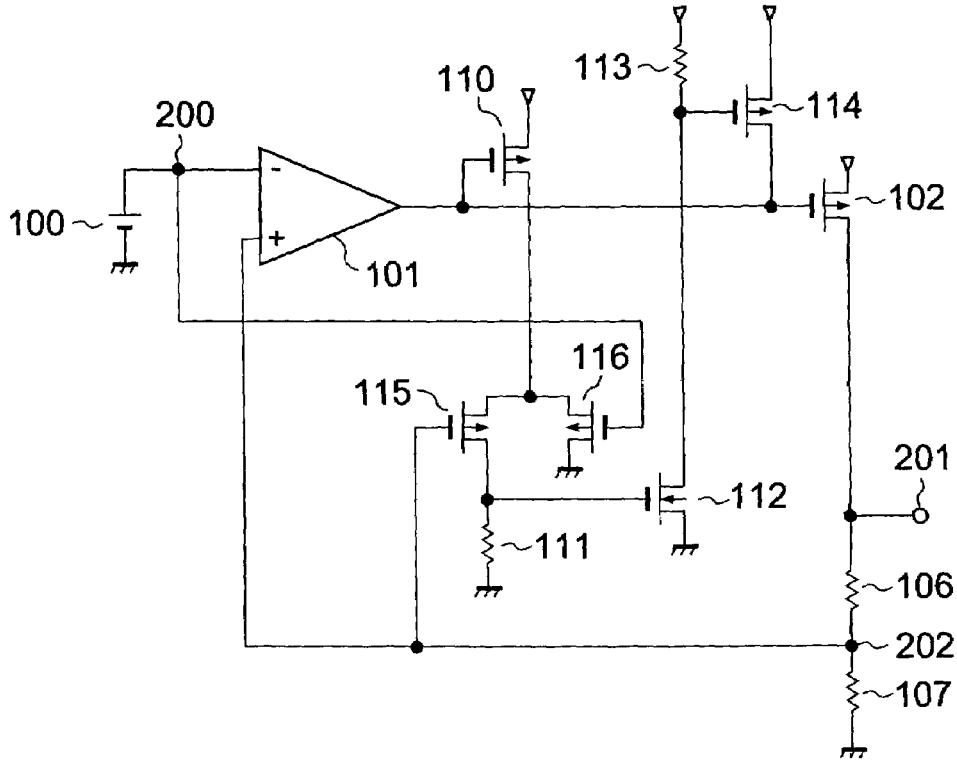
FIG. 1 is a circuit diagram of a voltage regulator including a fold-back type overcurrent limiting circuit according to the present invention.

FIG. 1 shows an embodiment of a voltage regulator including a fold-back type overcurrent limiting circuit according to the present invention. The overcurrent limiting circuit is constructed as follows so as to detect a current flowing into a P-channel enhancement type MOS driver transistor 102. The overcurrent limiting circuit has: a P-channel enhancement type MOS sense transistor 110 in which the gate and the source thereof are common to the P-channel enhancement type MOS driver transistor 102; P-channel enhancement type MOS transistors 115 and 116 composing the differential pair, in which the respective sources thereof are connected with the drain of the P-channel enhancement type MOS sense transistor 110; a resistor 111 in which one end thereof is connected with the drain of the P-channel enhancement type MOS transistor 115 and the other end thereof is grounded; an N-channel enhancement type MOS transistor 112 in which the gate thereof is connected with the drain of the P-channel enhancement type MOS transistor 115 and the source thereof is grounded; a resistor 113 in which one end thereof is connected with the drain of the N-channel enhancement type MOS transistor 112 and the other end thereof is connected with an input power source terminal; and a P-channel enhancement type MOS transistor 114 in which the gate thereof is connected with the drain of the N-channel enhancement type MOS transistor 112, the source thereof is connected with the input power source terminal, and the drain thereof is connected with the output voltage terminal of an error amplifier 101, the gate of the P-channel enhancement type MOS sense transistor 110, and the gate of the P-channel enhancement type MOS driver transistor 102. With such a structure, a current flowing into the P-channel enhancement type MOS driver transistor 102 is detected.

The gate of the P-channel enhancement type MOS transistor 115 is connected with a feedback voltage terminal. The gate of the P-channel enhancement type MOS transistor 116 is connected with a reference voltage terminal and the drain thereof is grounded.

When a current flowing into the P-channel enhancement type MOS transistor 115 and the resistor 111 becomes larger so that the N-channel enhancement type MOS transistor 112 is turned on, a current flows into the N-channel enhancement type MOS transistor 112, causing an increase in a voltage difference between both ends of the resistor 113, so that the P-channel enhancement type MOS transistor 114 is turned on. Accordingly, a gate voltage of the P-channel enhancement type MOS driver transistor 102 increases, thereby limiting the current supply to the P-channel enhancement type MOS driver transistor 102. Thus, by such a mechanism, overcurrent limiting operation is made.

When a specified output voltage is being outputted, a feedback voltage is equal to a reference voltage, so that a gate voltage of the P-channel enhancement type MOS transistor 115 is equal to a gate voltage of the P-channel enhancement type MOS transistor 116. Because the sources of the P-channel enhancement type MOS transistors 115 and 116 are common to each other, currents flowing into the P-channel enhancement type MOS transistors 115 and 116 are equal to each other and each current value is a half of a current flowing into the P-channel enhancement type MOS sense transistor 110. Therefore, when the half of the current flowing into the P-channel enhancement type MOS sense transistor 110, which is proportional to the output current, reaches a level at which the N-channel enhancement type MOS transistor 112 is turned on, the overcurrent limiting operation is made.

When the output current is lower than a specified value, the feedback voltage obtained by dividing the output voltage by the resistors drops as the output voltage drops. Accordingly, a difference between the gate voltage of the P-channel enhancement type MOS transistor 115 and the gate voltage of the P-channel enhancement type MOS transistor 116 becomes larger. Thus, a ratio of the current flowing into the P-channel enhancement type MOS transistor 115 to the current flowing into the P-channel enhancement type MOS sense transistor 110 increases.

Conversely, as the output voltage drops, the current flowing into the P-channel enhancement type MOS sense transistor 110, which is required to flow the predetermined amount of current into the P-channel enhancement type MOS transistor 115, may be made smaller accordingly.

The overcurrent limiting operation is made when the N-channel enhancement type MOS transistor 112 is turned on. Therefore, a current made to flow into the resistor 111 and the P-channel enhancement type MOS transistor 115, which is necessary to turn on the N-channel enhancement type MOS transistor 112, is kept constant regardless of the values of the output current and the output voltage.

Figure 2:
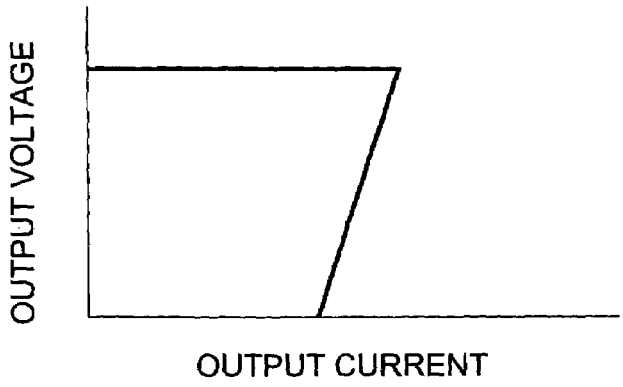
FIG. 2 shows a relationship between an output voltage and an output current in the voltage regulator including the fold-back type overcurrent limiting circuit according to the present invention.

However, as described above, the current flowing into the P-channel enhancement type MOS sense transistor 110, which is required to flow the predetermined amount of current into the P-channel enhancement type MOS transistor 115, may be made smaller as the output voltage lowers. In addition, the current flowing into the P-channel enhancement type MOS sense transistor 110 is proportional to the output current. Taking into consideration these relations, it can be said that the output current for which the overcurrent limiting operation is made lower as the output voltage lowers. That is, a relationship between the output voltage and the output current exhibits a fold-back shape as shown in FIG. 2.

Figure 3:
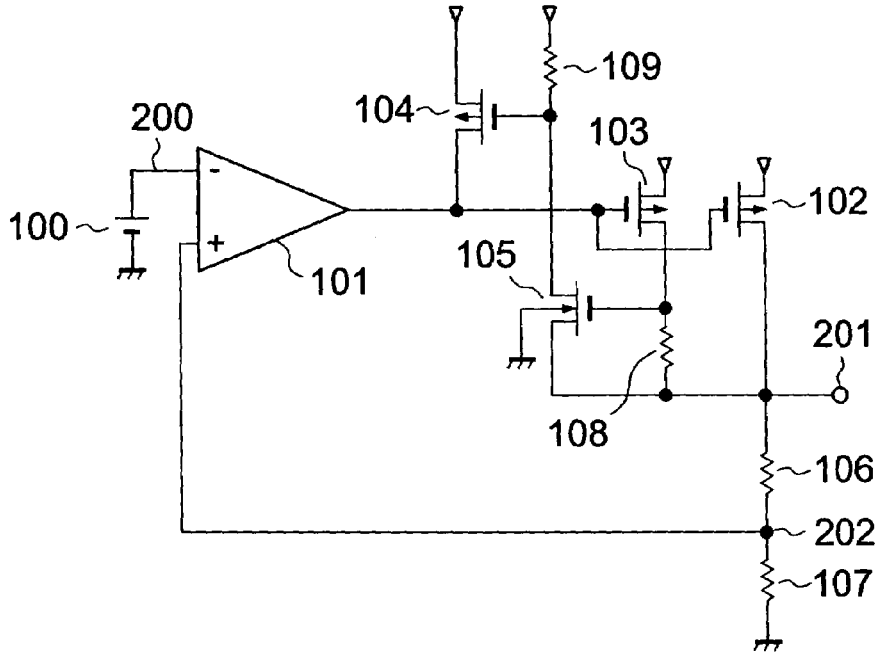
FIG.3 PRIOR ART
FIG. 3 is a circuit diagram of a conventional voltage regulator including a fold-back type overcurrent limiting circuit.
Figure 4:
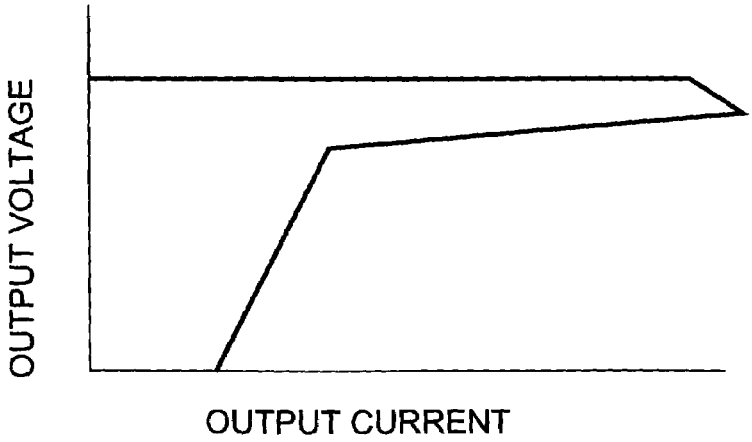
FIG.4 PRIOR ART
FIG. 4 shows a relationship between an output voltage and an output current in the conventional voltage regulator including the fold-back type overcurrent limiting circuit.
Figure 5:
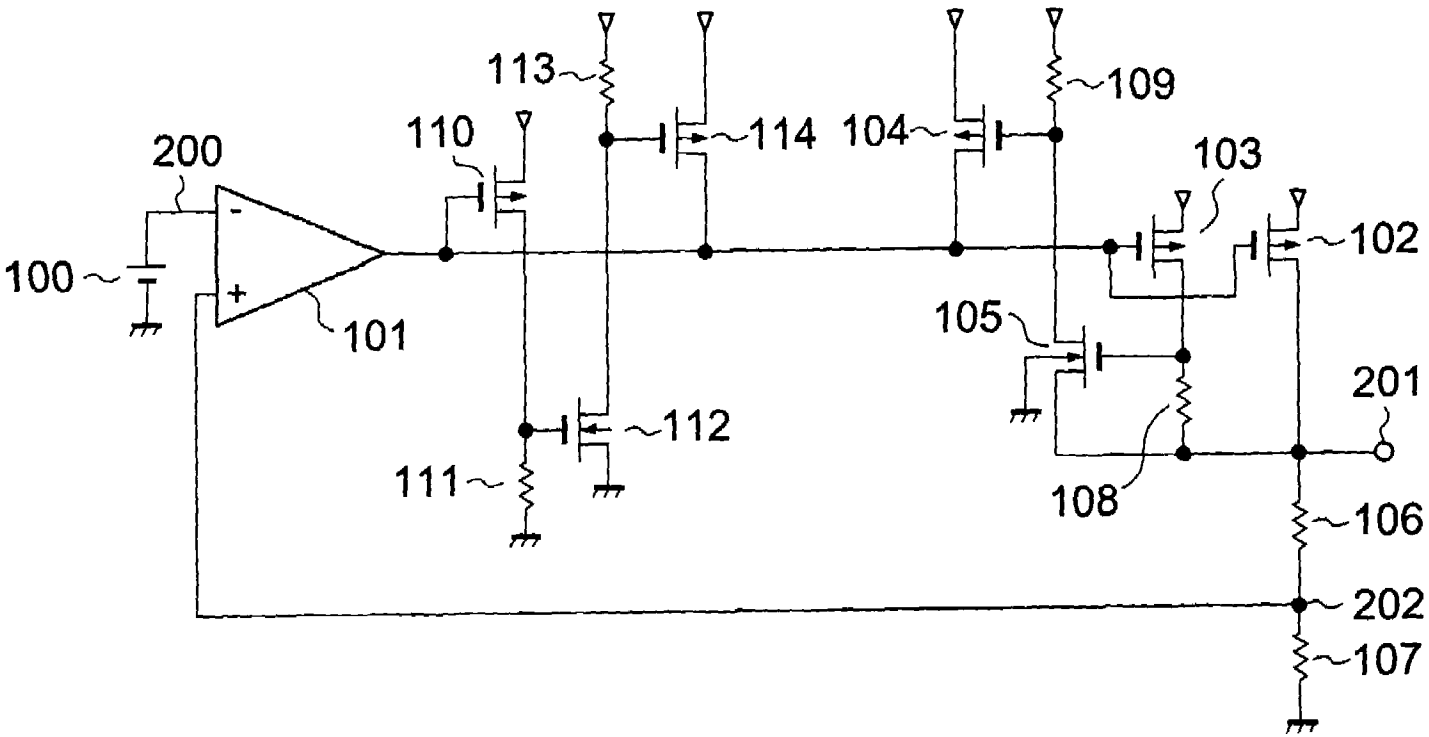
FIG.5 PRIOR ART
FIG. 5 is a circuit diagram of a conventional voltage regulator including both a fold-back type overcurrent limiting circuit and a drooping type overcurrent limiting circuit.
Figure 6:
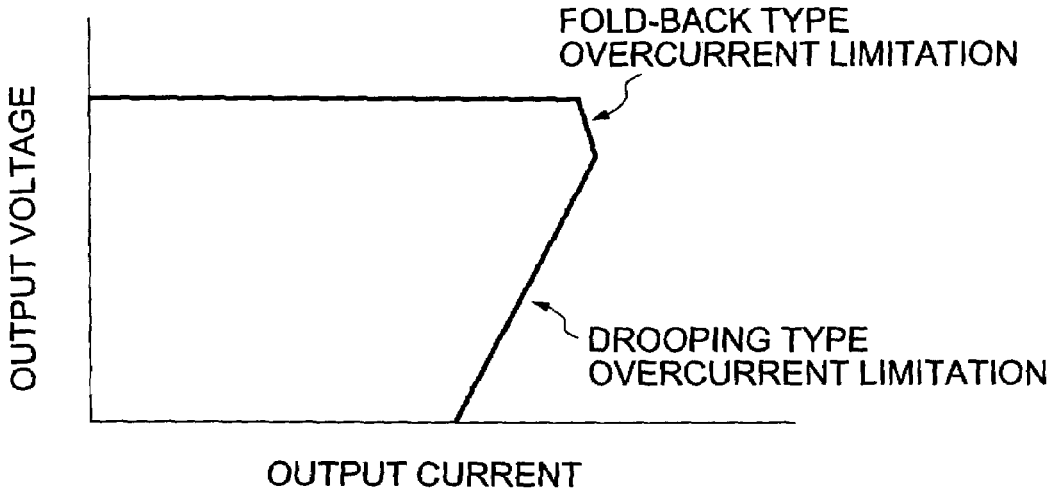
FIG.6 PRIOR ART
FIG. 6 shows a relationship between an output voltage and an output current in the conventional voltage regulator including both the fold-back type overcurrent limiting circuit and the drooping type overcurrent limiting circuit.

In the circuit of the embodiment shown in FIG. 1, there is no case where the fold-back type overcurrent limiting circuit does not operate when the input power source voltage and the output voltage are small, that is, when the difference between the input and output voltages is small in the case of the conventional fold-back overcurrent limiting circuit shown in FIG. 3. Therefore, it is unnecessary to provide the drooping type overcurrent limiting circuit in the case shown in FIG. 5. As a result, the circuit of the embodiment has such a feature that the entire circuit is simplified.

According to the present invention, the differential pair is added to the conventional drooping type overcurrent limiting circuit which operates even when the input power source voltage and the output voltage are small, that is, even when the difference between input and output voltages is small. In addition to this, the feedback voltage obtained by dividing the output voltage by the resistors is applied to one of the differential pair. Thus, the fold-back type overcurrent limiting circuit which operates even when the input power source voltage and the output voltage are small, that is, even when the difference between the input and output voltages is small is constructed. As a result, it is unnecessary to provide both the fold-back type overcurrent limiting circuit and the drooping type overcurrent limiting circuit as in the conventional case, whereby a circuit structure can be simplified.

What is claimed is:

1. A voltage regulator comprising:

a reference voltage source for outputting a reference voltage;

a voltage dividing circuit for dividing an output voltage;

a feedback voltage terminal to which a voltage obtained by dividing the output voltage is outputted;

an error amplifier to which the reference voltage and a voltage from the feedback voltage terminal are inputted;

a first transistor of a first conductivity type, which is connected in series between the voltage dividing circuit and an input power source terminal; and an overcurrent limiting circuit for outputting a signal for controlling the first transistor in response to an output of the error amplifier;

wherein the overcurrent limiting circuit includes;

a second transistor of the first conductivity type, which is connected between the input power source terminal and the error amplifier;

a first resistor connected between the input power source terminal and a terminal to which a signal for controlling the second transistor is inputted;

a third transistor of a second conductivity type, which is connected between the terminal to which the signal for controlling the second transistor is inputted and a ground potential terminal;

a second resistor connected between a terminal to which a signal for controlling the third transistor is inputted and the ground potential terminal;

a fourth transistor of the first conductivity type, which is connected between the input power source terminal and the second resistor, the output of the error amplifier being inputted to a control terminal of the fourth transistor; and a differential pair having a first input terminal and a second input terminal, which is connected between the fourth transistor and the second resistor, the first input terminal of the differential pair being connected with the feedback voltage terminal, and the second input terminal of the differential pair being connected with an output terminal of the reference voltage source.

2. A voltage regulator according to claim 1, wherein the differential pair includes:

a fifth transistor of the first conductivity type, which has the first input terminal; and a sixth transistor of the first conductivity type, which has the second input terminal, the fifth transistor being connected between the second resistor and the fourth transistor, and the sixth transistor being connected between the ground potential terminal and the fourth transistor.

* * * * *